US011718089B2

(12) United States Patent
Murai

(10) Patent No.: US 11,718,089 B2
(45) Date of Patent: Aug. 8, 2023

(54) LIQUID DISCHARGE DEVICE, LIQUID DISCHARGE METHOD, AND PROGRAM

(71) Applicant: Toshifumi Murai, Tokyo (JP)

(72) Inventor: Toshifumi Murai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/692,124

(22) Filed: Mar. 10, 2022

(65) Prior Publication Data

US 2022/0314604 A1 Oct. 6, 2022

(30) Foreign Application Priority Data

Apr. 6, 2021 (JP) ..... 2021 -064979

(51) Int. Cl.
*B41J 2/045* (2006.01)

(52) U.S. Cl.
CPC ..... *B41J 2/04505* (2013.01); *B41J 2/04573* (2013.01)

(58) Field of Classification Search
CPC ..... B41J 2/0451; B41J 2/165; B41J 2/14427; B41J 2/14129; B41J 2/0458; B41J 29/393; B41J 2/04505; B41J 2/04573; B41J 29/38; B41J 29/387; B41J 11/008; B41J 11/0095
See application file for complete search history.

(56) References Cited

U.S. PATENT DOCUMENTS

2016/0325566 A1* 11/2016 Kurane ..... B41J 11/0095
2018/0272694 A1 9/2018 Gohda et al.
2020/0171854 A1 6/2020 Sunaoshi et al.

FOREIGN PATENT DOCUMENTS

JP 2017-109487 6/2017
JP 2018-158573 10/2018
JP 2019-010751 1/2019

* cited by examiner

*Primary Examiner* — Kristal Feggins
(74) *Attorney, Agent, or Firm* — Duft & Bornsen, PC

(57) ABSTRACT

A liquid discharge device includes: a transporter to transport a recording medium in a transport direction by using a rotating body; a first detector to detect a first measure of detection indicating an amount of rotation of the rotating body; a second detector to detect a second measure of detection based on a pattern on the recording medium identified by image-capturing the recording medium, the second measure of detection indicating a position of the recording medium in the transport direction, a transport speed of the recording medium in the transport direction, or a combination of the position and the speed; a corrector to calculate a second timing by correcting a first timing based on the second measure of detection, the first timing being for discharging a liquid determined based on the first measure of detection; and a discharger to discharge the liquid to the recording medium at the second timing.

5 Claims, 10 Drawing Sheets

LIQUID DISCHARGE DEVICE, LIQUID DISCHARGE METHOD, AND PROGRAM

CROSS-REFERENCE TO RELATED APPLICATIONS

The present application claims priority under 35 U.S.C. § 119 to Japanese Patent Application No. 2021-064979, filed Apr. 6, 2021, the contents of which are incorporated herein by reference in their entirety.

BACKGROUND OF THE INVENTION

1. Field of the Invention

The disclosure herein relates to a liquid discharge device, a liquid discharge method, and a program.

2. Description of the Related Art

There is an art that is known to allow inkjet heads to discharge a liquid such as ink to form images.

To be more specific, first, a printing device includes, for example, an upstream roller and a downstream roller, which rotate driven by the web that is transported. Furthermore, an upstream encoder and a downstream encoder that output pulse signals according to the angle of rotation are provided in the upstream roller and the downstream roller. Thus, the printing device has encoders placed near the inkjet heads so as to correspond to each inkjet. Then, there is an art that is known to prevent the landing positions of ink from being unsynchronized between these encoders, and reduce the deterioration of print quality (see, for example, patent document 1).

CITATION LIST

Patent Document

Patent Document 1: Japanese Unexamined Patent Application Publication No. 2019-10751

SUMMARY OF THE INVENTION

According to at least one aspect of the present disclosure, a liquid discharge device includes: a transporter configured to transport a recording medium in a transport direction by using a rotating body; a first detector configured to detect a first measure of detection indicating an amount of rotation of the rotating body; a second detector configured to detect a second measure of detection based on a pattern on the recording medium identified by image-capturing the recording medium, the second measure of detection indicating a position of the recording medium in the transport direction, a transport speed of the recording medium in the transport direction, or a combination of the position and the speed; a corrector configured to calculate a second timing by correcting a first timing based on the second measure of detection, the first timing being for discharging a liquid determined based on the first measure of detection; and a discharger configured to discharge the liquid to the recording medium at the second timing.

DESCRIPTION OF THE PREFERRED EMBODIMENTS

It is a general object of the present disclosure to improve the accuracy of landing of a liquid.

According to the present disclosure, the accuracy of landing of a liquid can be improved.

Now, specific examples of the present disclosure will be described below with reference to the accompanying drawings. Note that the embodiments of the present disclosure are by no means limited to the specific examples described below.

First Embodiment

An example case in which a liquid discharge device forms images will be described below. That is, in the example described below, the liquid that is discharged by the liquid discharge device is ink. As the ink lands on paper, which is an example of the recording medium, images are formed.

[Example Overall Structure of Image Forming Device]

Figure 1:
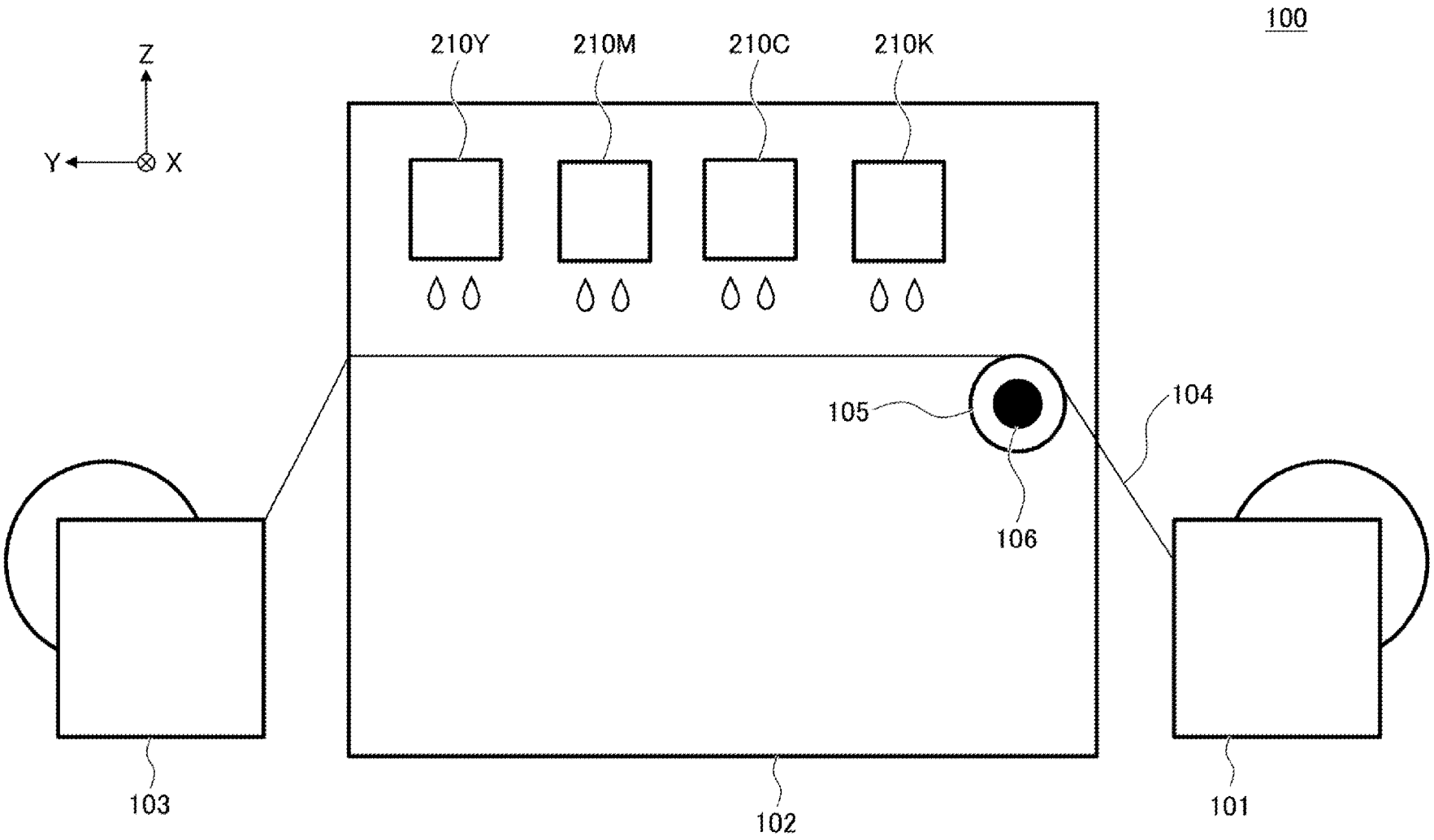
FIG. 1 is a diagram illustrating an example overall structure of an image forming device 100.

FIG. 1 is a diagram illustrating an example overall structure of an image forming device 100. For example, the image forming device 100 is composed of a paper feeding device 101, an inkjet device 102, which is an example of the liquid discharge device, a paper ejection device 103, and so forth. Note that the image forming device 100 may also include devices that perform subsequent processes and the like.

Now, an example case in which the paper b is continuous form paper, that is, what is known as a "web," 104, will be described. However, the recording medium does not have to be continuous form paper. For example, the recording medium may be cut paper or the like. Furthermore, when using cut paper, the image forming device 100 may be configured to move a belt, on which the recording medium is placed and transported.

Note that, in the following description, the direction of transport will be referred to as the "transport direction Y." To be more specific, in the accompanying drawings, the transport direction Y is the direction from right to left. Likewise, the vertical direction will be referred to as the "vertical direction Z," and the direction that is orthogonal to the direction of transport will be referred to as the "orthogonal direction X." Furthermore, in the following description, the side where paper is fed (the right side in the drawings) may be referred to as "upstream," and the side where paper is ejected (the left side in the drawings) may be referred to as "downstream."

The paper feeding device 101 feeds the web 104 into the inkjet device 102. Then, the inkjet device 102 discharges ink onto the web 104 and forms images thereon. Following this, the paper ejection device 103 ejects the web 104.

The inkjet device 102 forms images with, for example, four colors K, C, M, and Y. In the example illustrated, the inkjet device 102 includes b a K head 210K that discharges the K ink, a C head 210C that discharges the C ink, an M head 210M that discharges the M ink, and a Y head 210Y that discharges the Y ink.

A transport roller 105, which is an example of the rotating body, is placed, for example, at a position upstream of any head, and downstream of the paper feeding device 101. Note that other rollers, actuators, control devices, and so forth may be used to transport the recording medium.

A transport roller 105 is provided with a detector, which detects the amount of rotation. For example, the detector is an encoder 106.

The encoder 106 detects the angle of rotation or the speed of rotation of the transport roller 105 as a detected measure, detects both of these. That is, the encoder 106 detects measures that relate to, for example, the transport of the recording medium by the transport roller 105. In the example described below, the quantity that is detected by the encoder 106 will be referred to as the "first measure of detection."

Figure 2:
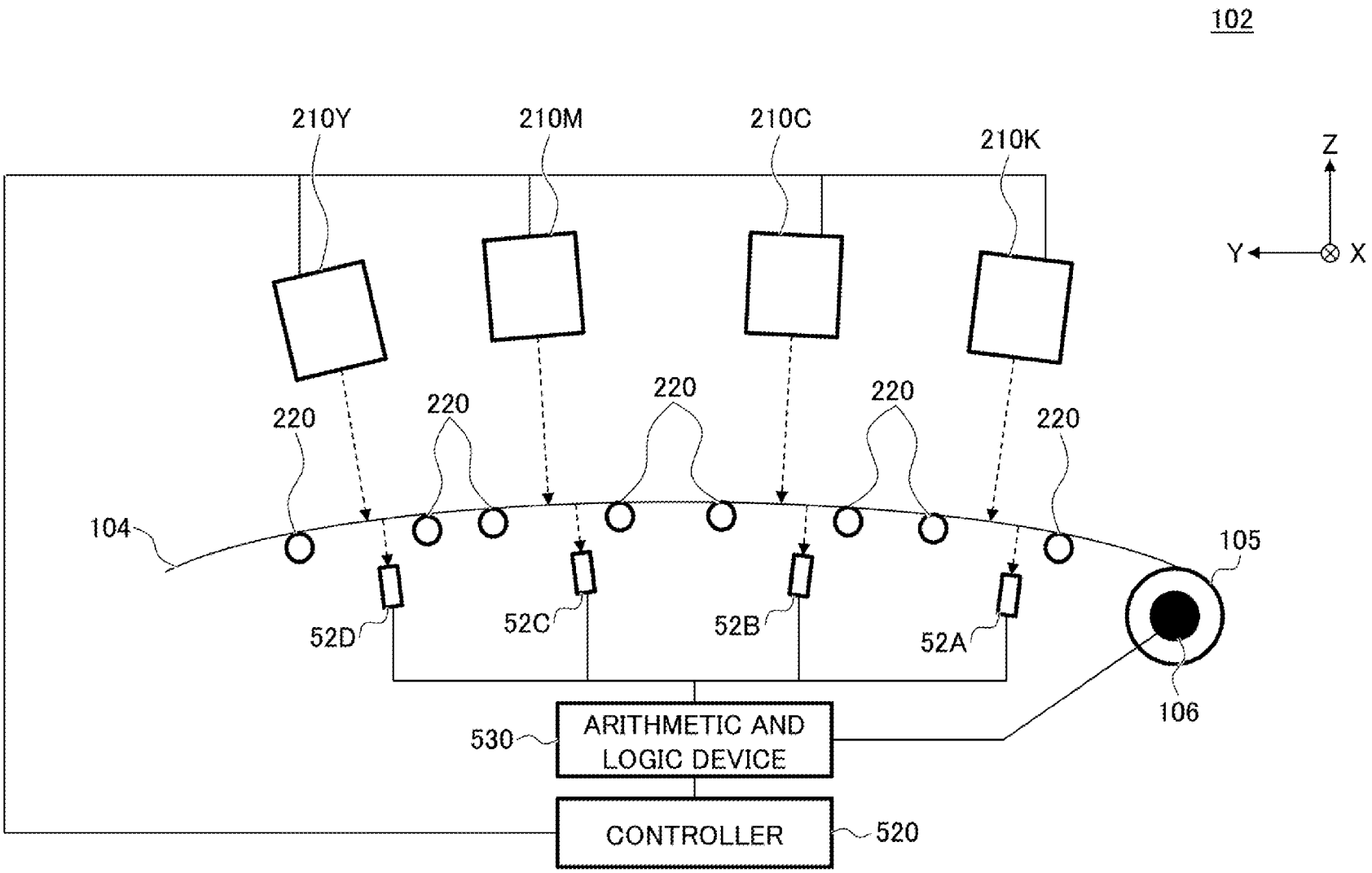
FIG. 2 is a diagram illustrating an example structure of a liquid discharge device.

FIG. 2 is a diagram illustrating an example structure of the liquid discharge device. For example, the inkjet device 102 includes a transport roller 105, an encoder 106, a K head 210K, a C head 210C, an M head 210M, a Y head 210Y, driven rollers 220, and so forth.

Also, the inkjet device 102 includes a first image sensor 52A, a second image sensor 52B, a third image sensor 52C, and a fourth image sensor 52D. Hereinafter, the first image sensor 52A, the second image sensor 52B, the third image sensor 52C, and the fourth image sensor 52D may be collectively referred to as "image sensors 52."

Furthermore, the inkjet device 102 includes a controller 520, an arithmetic and logic device 530, and so forth.

The encoder 106 generates pulses in accordance with the rotation of the transport roller 105. After generating pulses, the encoder 106 transmits the pulses to the arithmetic and logic device 530.

The image sensors 52 image-capture the surface of the web 104 at regular intervals. After capturing the images, the image sensors 52 transmit the captured image data to the arithmetic and logic device 530. Then, based on the captured image data, the arithmetic and logic device 530 detects the patterns formed on the surface of the web 104. Note that the image sensors 52 may target the patterns and the like that are provided inside the web 104.

Next, the arithmetic and logic device 530 calculates the displacement of the patterns. By this means, the arithmetic and logic device 530 calculates the position of the web 104, its speed of transport, or both.

Note that, as illustrated in the drawing, the image sensors 52 may be placed upstream of the position where the ink discharged by each head lands. When the image sensors 52 are placed at positions away from the ink-landing positions like this, the arithmetic and logic device 530 may calculate the position of the web 104, its speed of transport, or both, by converting these into ink-landing positions.

In the following description, when the image sensors 52 produce a detection result, this will be referred to as the "second measure of detection."

The controller 520 is a memory device, an arithmetic and logic device, a control device, and so forth. The controller 520 controls, for example, each head so as to discharge ink at timings based on calculation results in the arithmetic and logic device 530, and the like. In this way, the controller 520 controls devices such as heads. Note that the inkjet device 102 may include other control devices besides the controller 520.

[Examples of Detection and Correction]

Figure 3:
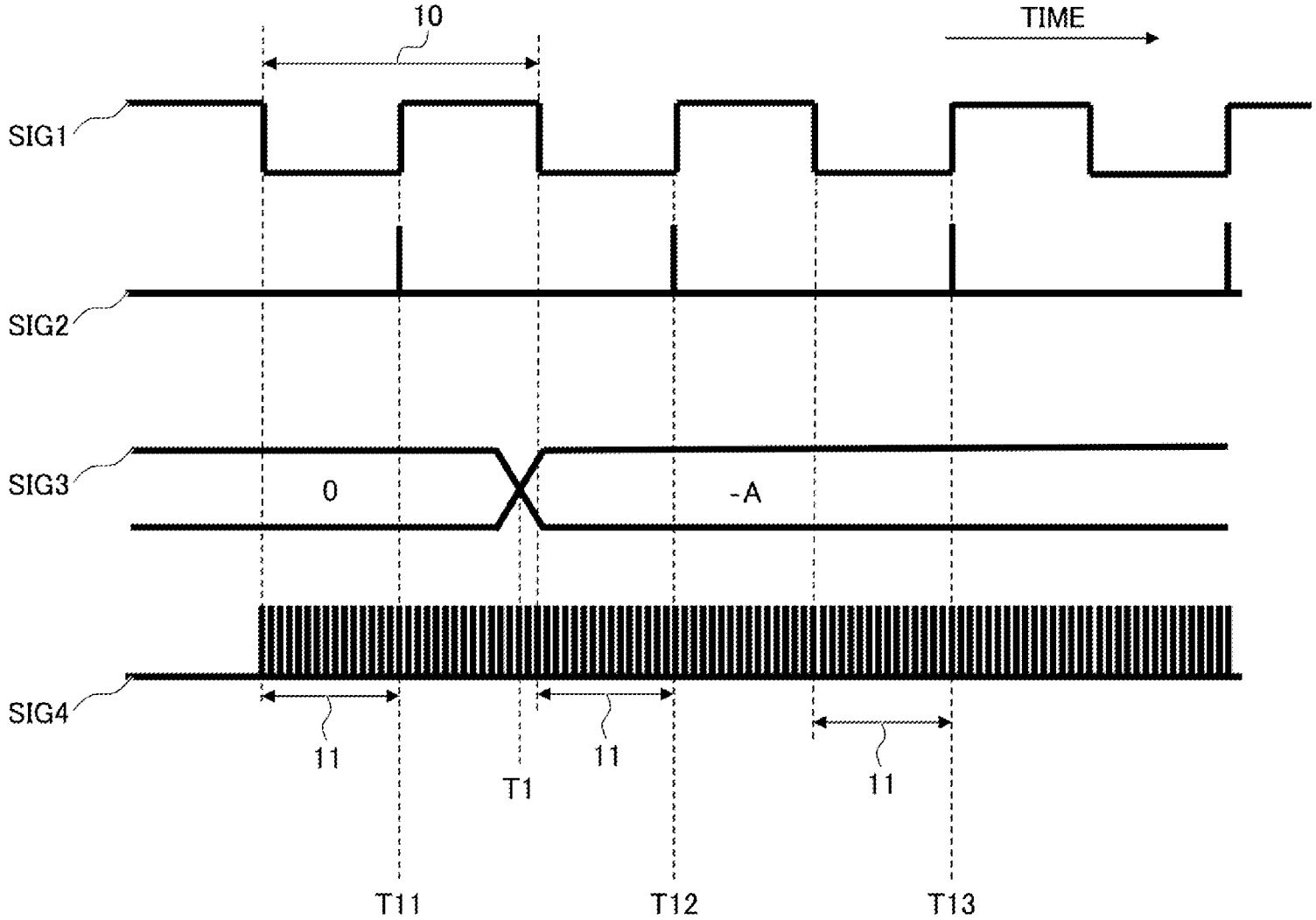
FIG. 3 is a diagram illustrating examples of liquid discharge timings before correction.

FIG. 3 is a diagram illustrating examples of liquid discharge timings before correction. Below, an example in which the encoder 106 generates the first pulse such as the first signal SIG1 will be described.

The first signal SIG1 is a signal to represent the first measure of detection. For example, the period 10 is one period of the first signal SIG1. To be more specific, the period 10 represents, for example, one rotation of the transport roller 105. However, the period 10 is not limited to one rotation, and may represent a different amount of rotation that is set in advance.

The second signal SIG2 is a signal to indicate the timing for discharging the liquid. That is, each head is controlled to discharge the liquid at the timing indicated by the second signal SIG2. Furthermore, assume that, in this example, the second signal SIG2 is high-active. That is, referring to the drawing, when the second signal SIG2 is "high," each head discharges the liquid.

For example, when the timing to discharge the liquid is determined based on the first measure of detection, timings such as the eleventh timing T11, the twelfth timing T12, the thirteenth timing T13, and so forth are determined. In the following description, the timing that is determined based on the first measure of detection, that is, the timing for discharging the liquid that is not corrected yet, such as the eleventh timing T11, the twelfth timing T12, the thirteenth timing T13, and so forth, will be referred to as the "first timing."

Below, an example in which the liquid is discharged once every 10 periods will be described. First, the first timing is determined by the falling edge, for example, as illustrated in FIG. 3. The first timing determined in this way is corrected based on the following third signal SIG3 and the like.

The third signal SIG3 is a signal to represent the second measure of detection. To be more specific, in the example illustrated, the initial value of the third signal SIG3 is "0." That is, the state in which the amount of correction is "0" is a state in which no desynchronization or the like is found, and in which therefore the liquid can be discharged at the eleventh timing T11, the twelfth timing T12, and the thirteenth timing T13, without correction.

Furthermore, in this example, the amount of correction is calculated as "A," based on the patterns detected by the image sensors 52. Consequently, based on the calculation result, the value of the third signal SIG3 is updated from "0" to "−A" at an update timing T1. Note that "+" and "−" in the amount of correction shows whether the timing is put forward or backward in the transport direction.

The timing is corrected, for example, when the speed of transport varies. To be more specific, assuming that the speed of transport varies while the recording medium is being transported, if the liquid is discharged at the timing as initially set, desynchronization might show on the image that is formed. So, the inkjet device 102 calculates the speed of transport based on, for example, the displacement of patterns detected by the image sensors 52. In this way, the inkjet device 102 calculates the variation in transport speed and so forth. So, when the calculation shows that the speed of transport varies, the inkjet device 102 recognizes that this variation of transport speed might cause desynchronization. Then, the inkjet device 102 calculates an amount of correction that would negate the desynchronization.

Note that the amount of correction may be calculated by taking into account factors other than the variation of transport speed. For example, when the positions where the image sensors' detection takes place and the positions directly under each head do not match, the amount of correction may be calculated assuming the positions directly under each head.

Now, an example will be described below, in which the discharge timing, namely the thirteenth timing T13 prior to correction, is targeted for correction using the amount of correction calculated at the update timing T1. That is, in the example described below, the "first timing," which is the timing for discharging the liquid, and which is determined based on the first measure of detection, is the thirteenth timing T13.

The amount of correction is preferably calculated by using the count value of second pulses as shown below.

The fourth signal SIG4 is a signal to represent the second pulses. The second pulses are signals obtained by dividing the first pulse in equal portions. Note that how many portions the first pulse should be divided into to have the second pulses is set in advance.

Below, assume that, prior to correction, the count value of second pulses during the time from the start of the period 10 (where the start is represented by the falling edge of the first signal SIG1 in the drawing) up to the timing to discharge the liquid (hereinafter referred to as the "discharge timing 11") is "n." Likewise, at the twelfth timing T12 and at the thirteenth timing T13, too, before correction, the discharge timing 11 corresponds to where the count value of second pulses is "n."

It is desirable for the thirteenth timing T13 to be corrected by using the count value of second pulses. As described above, when the count value of second pulses or the like is used, the inkjet device 102 can perform processes such as correction by using signal processing. It then follows that the inkjet device 102 can perform processes such as correction at higher speeds than when using software or the like.

Figure 4:
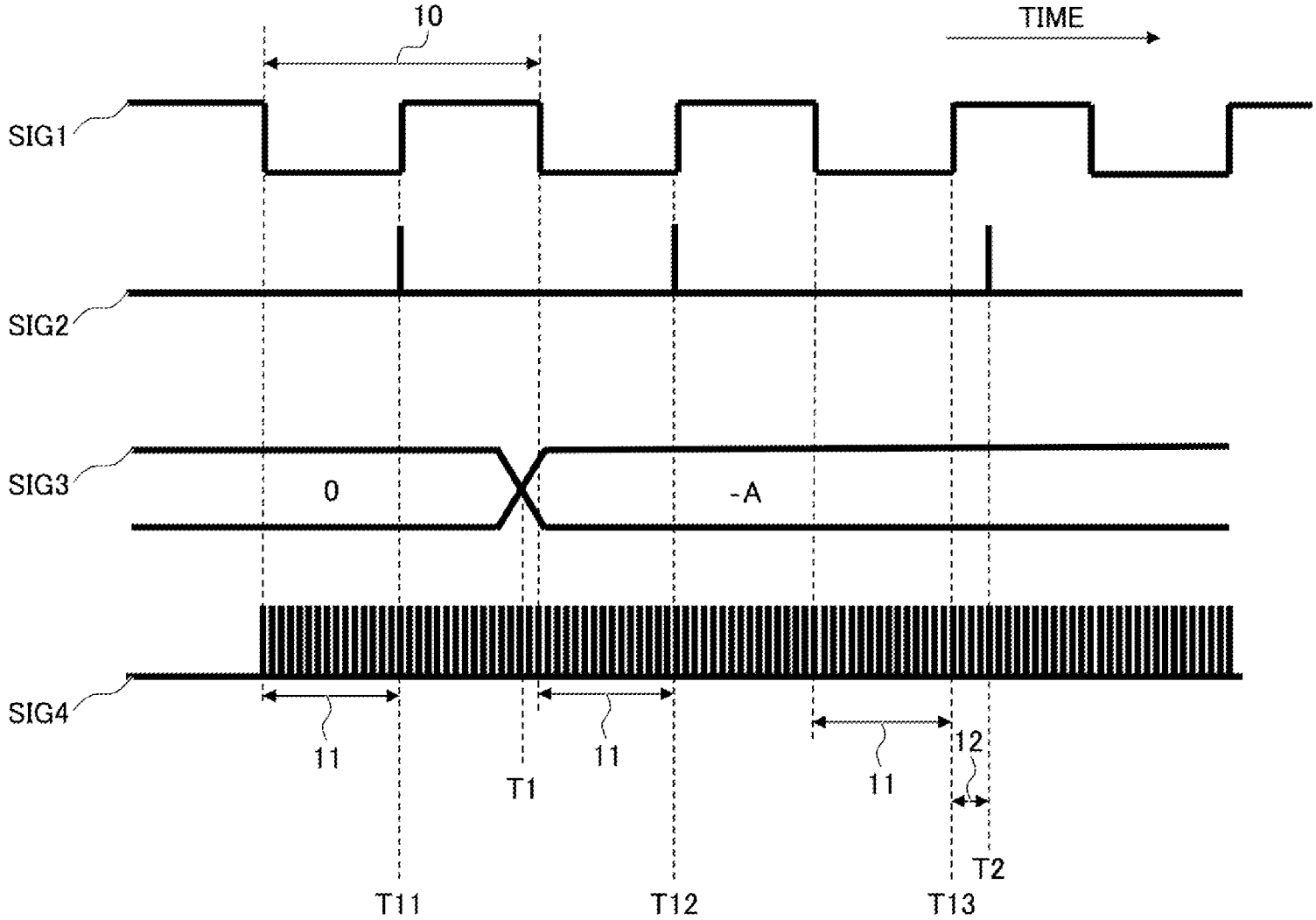
FIG. 4 is a diagram illustrating examples of liquid discharge timings after correction.

FIG. 4 is a diagram illustrating examples of liquid discharge timings after correction. Comparing between FIG. 3 and FIG. 4, the difference is that the first timing of the thirteenth timing T13 in FIG. 3 is corrected into the second timing T2 in FIG. 4.

The second timing T2 is the timing given by correcting the discharge timing 11 before correction, so as to delay the discharge timing 11 before correction by the amount of correction 12. For example, it is desirable for the second timing T2 to be calculated by using the count value of second pulses so that "the discharge timing 11+ the amount of correction 12" corresponds to where the count value of second pulses is "m." In this way, it is desirable to calculate the amount of correction 12 by converting it into the number of second pulses.

For example, the speed of transport varies due to various factors such as when the rotating body is eccentric, the recording medium slips with respect to the rotating body, the recording medium expands or contracts, or a combination of these occurs. The difference between the first timing and the position on the recording medium where the ink from each head lands, produced due to these factors, determines the proportion of the amount of correction 12. Consequently, the liquid discharge device corrects the timing by using the amount of correction of 12.

As described above, the first timing determined based on the first measure of detection, which shows the amount of the rotating body's rotation, is corrected based on the second measure of detection determined based on the results of detection in the image sensors 52 and the like. When the liquid is discharged at the second timing generated by applying such a correction, the liquid discharge device can reduce the desynchronization of positions due to the above-mentioned factors, and allow the liquid to land with improved accuracy.

In addition, depending on the amount of correction in terms of "+" and "−," the timing may be corrected in the direction to make the timing earlier than before the correction (in the drawing, the timing is corrected to the left from before the correction).

Furthermore, as illustrated in FIG. 2, if the liquid discharge device has a number of heads, it is desirable to provide image sensors 52 on a per head basis. Then, for each head, it is desirable to correct the timing for discharge based on the second measure of detection obtained in each image sensor.

Then, at a downstream head, it is desirable to correct the timing for discharge based on the result of correction at an upstream head. When the heads are lined up from upstream to downstream in the order of K, C, M, and Y, as illustrated in FIG. 2, for example, it is desirable to correct the C head 210C based on the result of b correction at the upstream K head 210K.

At heads located downstream, such as the C, M, and Y heads, the desynchronization tends to accumulate when the encoder 106 or the like is used. That is, when the encoder 106 serves as a point of reference, the downstream heads tend to show greater desynchronization. So, when correcting the timing, it is desirable to check the results of correction in the upstream.

To be more specific, it is desirable to correct the difference from the results of correction in the upstream. For example, at the C head 210C, it is desirable to make correction after correction is made for the K head 210K. That is, it is more desirable to correct the desynchronization that is found in the downstream of the K head 210K. In this way, by allowing the liquid discharge device to correct the difference from upstream discharge parts, the liquid discharge device can allow the liquid to land with even more improved accuracy.

Second Embodiment

A second embodiment is applicable, for example, when corrections are made as follows.

Figure 5:
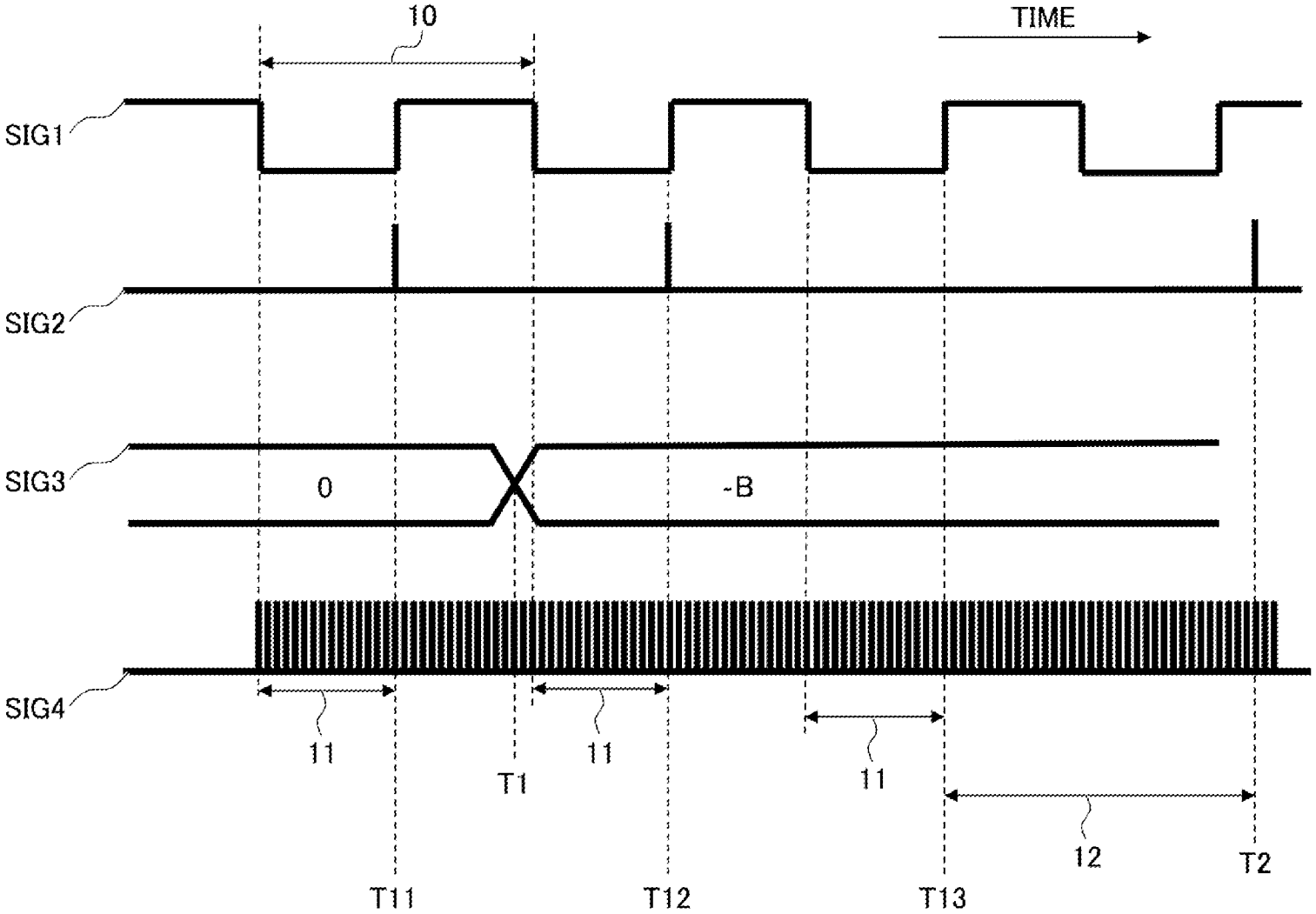
FIG. 5 is a diagram illustrating an example of correction according to a second embodiment.

FIG. 5 is a diagram illustrating an example of correction according to the second embodiment. Compared to the first embodiment, the difference is that the amount of correction 12 is large. To be more specific, the amount of correction 12 according to the second embodiment is equal to or less than one period of the first pulse. Hereinafter, this amount of correction will be "−B."

When the amount of correction 12 is large like this, it is desirable if the inkjet device 102 changes the timing to serve as a point of reference (hereinafter referred to as the "reference timing") for the second timing T2.

Figure 6:
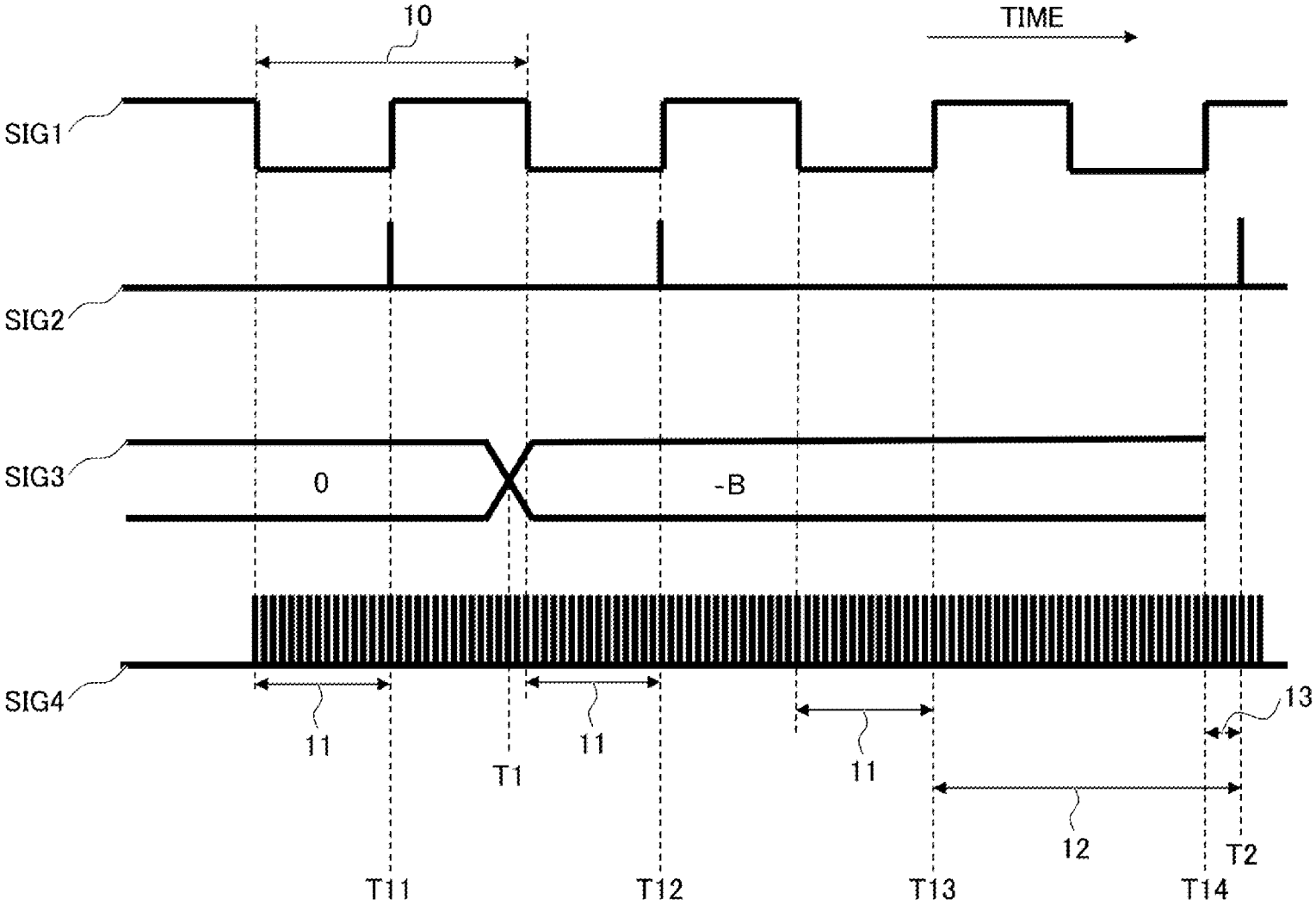
FIG. 6 is a diagram illustrating an example of change of reference timing.

FIG. 6 is a diagram illustrating an example of changing the reference timing. The drawing illustrates an example in which the reference timing is changed to the fourteenth timing T14.

Prior to the change, the thirteenth timing T13 is the reference timing. So, the inkjet device 102 changes the reference timing from the thirteenth timing T13 to the fourteenth timing T14. That is, the reference timing is changed so as to be delayed by one period in the first signal SIG1. Note that, when the amount of correction 12 is two periods or more, the reference timing may be subjected to a change of two periods or more.

When the reference timing is changed to the fourteenth timing T14 in this way, the second timing T2 is calculated as a changed amount of correction 13.

Not changing the reference timing might cause the counter value or the like to become a large value, such as the case with the amount of b correction 12, which then might result in the control counter's overflow (also referred to simply as an "overflow" or the like). In particular, when the speed of transport varies significantly, such as one period, then two periods, and so forth, the amount of correction is likely to accumulate. So, when the control counter's overflow or the like occurs, a discharge defect or the like might occur.

On the other hand, by changing the reference timing, it is possible to represent the amount of correction 12 by using a small value such as the changed amount of correction 13. It then follows that, by changing the reference timing, for example, it is possible to prevent the control counter from overflowing.

[Example of Overall Process]

Figure 7:
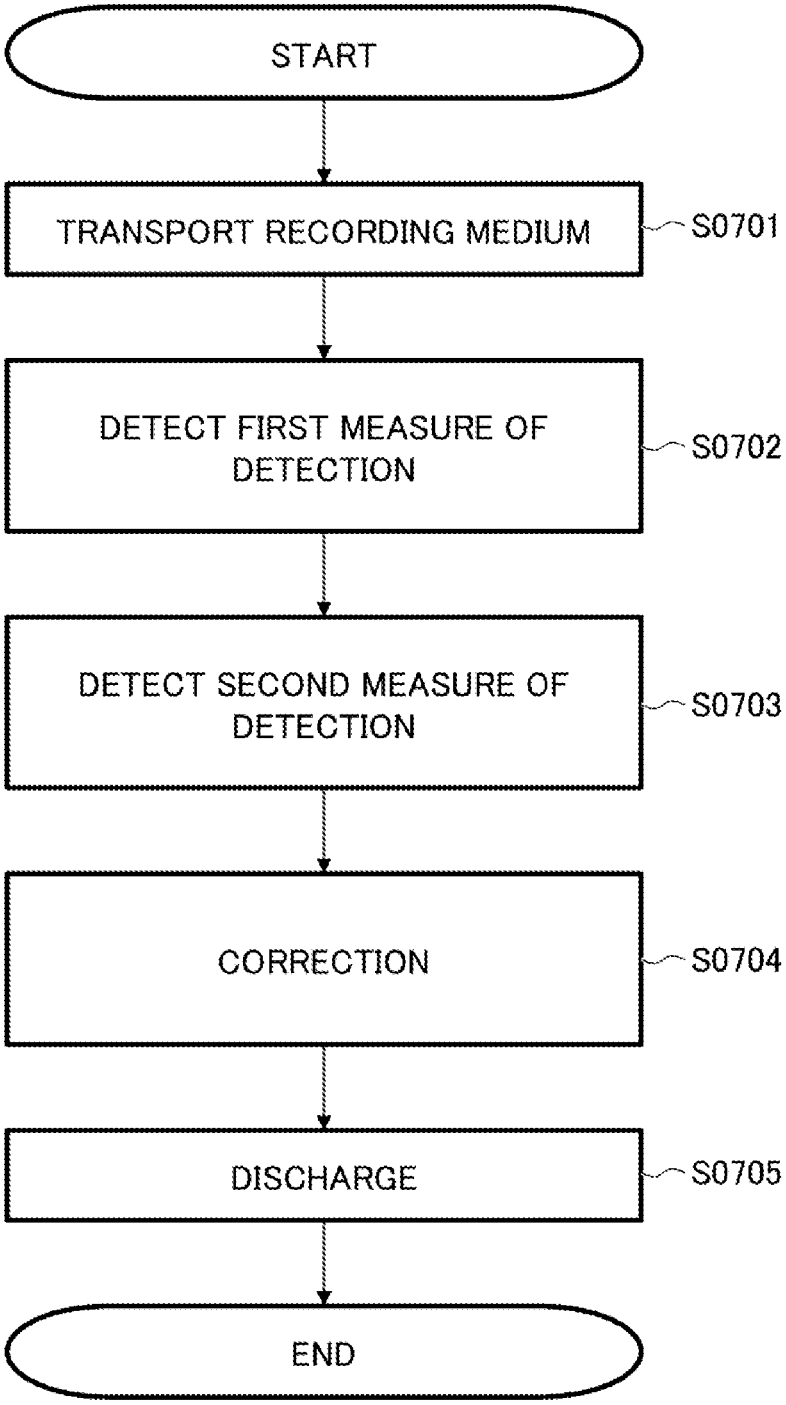
FIG. 7 is a diagram illustrating an example of the overall process.

FIG. 7 is a diagram illustrating an example of the overall process.

In step S0701, the liquid discharge device performs a transport step of transporting the recording medium by using the rotating body. To be more specific, the liquid discharge device transports the recording medium from upstream to downstream, as illustrated in FIG. 1.

In step S0702, the liquid discharge device performs a first detection step of detecting the first measure of detection. To be more specific, the liquid discharge device generates a signal to b represent the first measure of detection, such as the first signal SIG1 illustrated in in FIG. 2.

In step S0703, the liquid discharge device performs a second detection step of detecting the second measure of detection. To be more specific, the liquid discharge device generates a signal to represent the second measure of detection, such as the third signal SIG3 illustrated in FIG. 2.

In step S0704, the liquid discharge device performs a correction step of correcting the first timing and calculating the second timing. To be more specific, the liquid discharge device calculates the second timing T2 by correcting the thirteenth timing T13 illustrated in FIG. 4.

In step S0705, the liquid discharge device performs a discharge step of discharging the liquid. To be more specific, the liquid discharge device exerts control so that the liquid is discharged at the second timing T2 illustrated in FIG. 4.

Note that the liquid discharge device does not have to perform the overall process in the order illustrated in the drawing. For example, each step may be performed in parallel, in a redundant manner, or in a different order than shown.

[Example of Functional Structure]

Figure 8:
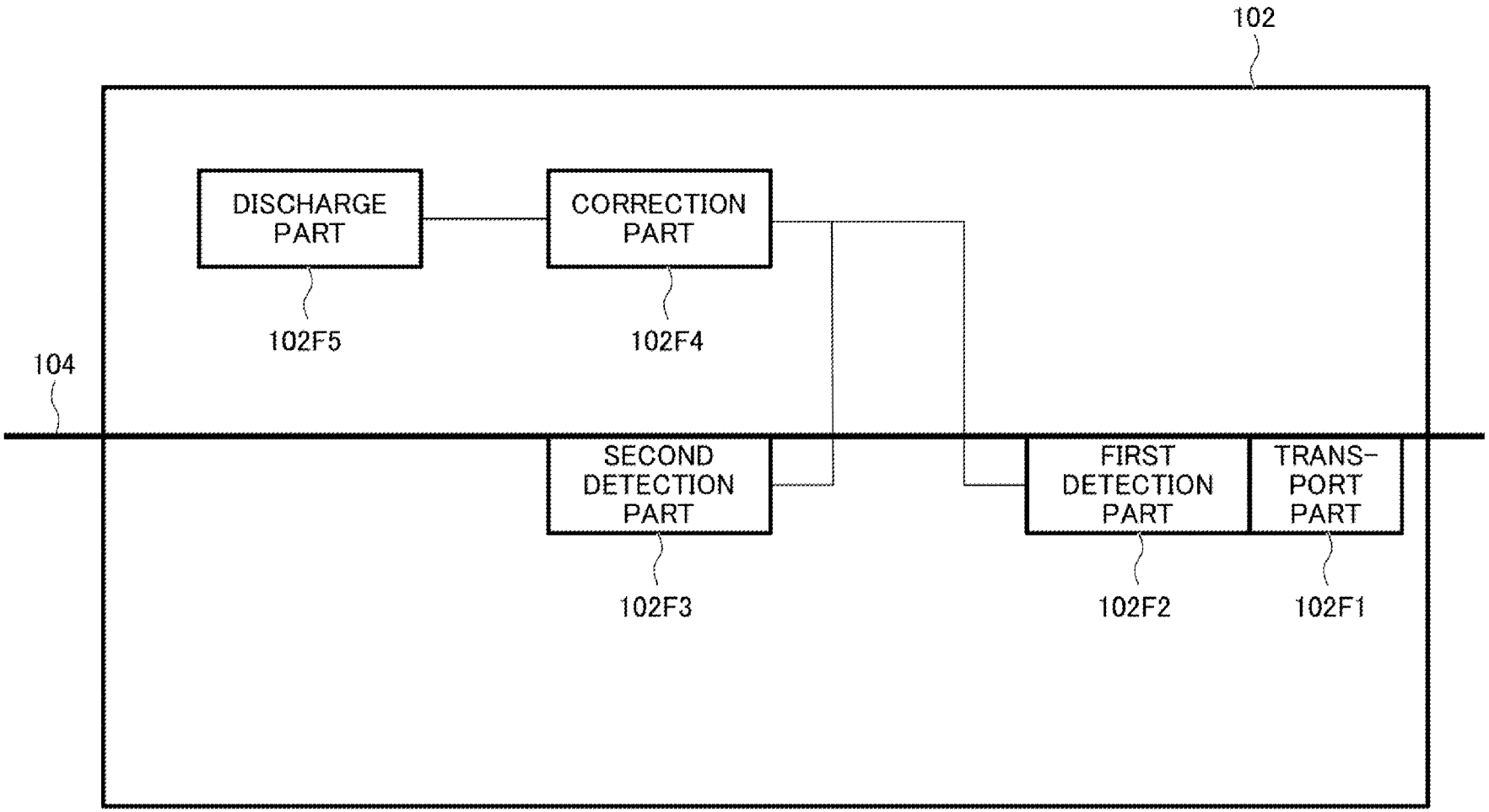
FIG. 8 is a diagram illustrating an example functional structure.

FIG. 8 is a diagram illustrating example functional structure. For example, the inkjet device 102 includes a transport part 102F1, a first detection part 102F2, a second detection part 102F3, a correction part 102F4, a discharge part 102F5, and so forth.

The transport part 102F1 performs a transport step of transporting the recording medium in the transport direction by using the rotating body. For example, the transport part 102F1 is implemented by using the transport roller 105 or the like.

The first detection part 102F2 performs the first detection step of detecting the first measure of detection. For example, the first detection part 102F2 is implemented by using the encoder 106 or the like.

The second detection part 102F3 performs a second detection step of detecting the second measure of detection. For example, the second detection part 102F3 is implemented by using the image sensors 52 or the like.

The correction part 102F4 performs a correction step of correcting the first timing based on the second measure of detection and calculating the second timing. For example, the correction part 102F4 is implemented by using the arithmetic and logic device 530 or the like.

The discharge part 102F5 performs a discharge step of discharging the liquid to the recording medium at the second timing. For example, the discharge part 102F5 is implemented by using the K head 210K, the C head 210C, the M head 210M, the Y head 210Y, the controller 520, and the like.

Given the above functional structure, the inkjet device 102 can first calculate the first timing based on the first measure of detection. However, when, for example, the speed of transport varies, the accuracy of the liquid's landing might deteriorate at the first timing. So, the inkjet device 102 calculates the second timing by correcting the first timing, by using the second measure of detection that is determined based on the results of detection in the image sensors 52. When the liquid is discharged at the second timing generated by applying such a correction, the liquid discharge device can reduce the desynchronization of positions, and allow the liquid to land with improved accuracy.

[Example of Liquid Discharge System]

The liquid discharge system including the liquid discharge device may be structured as follows.

Figure 9:
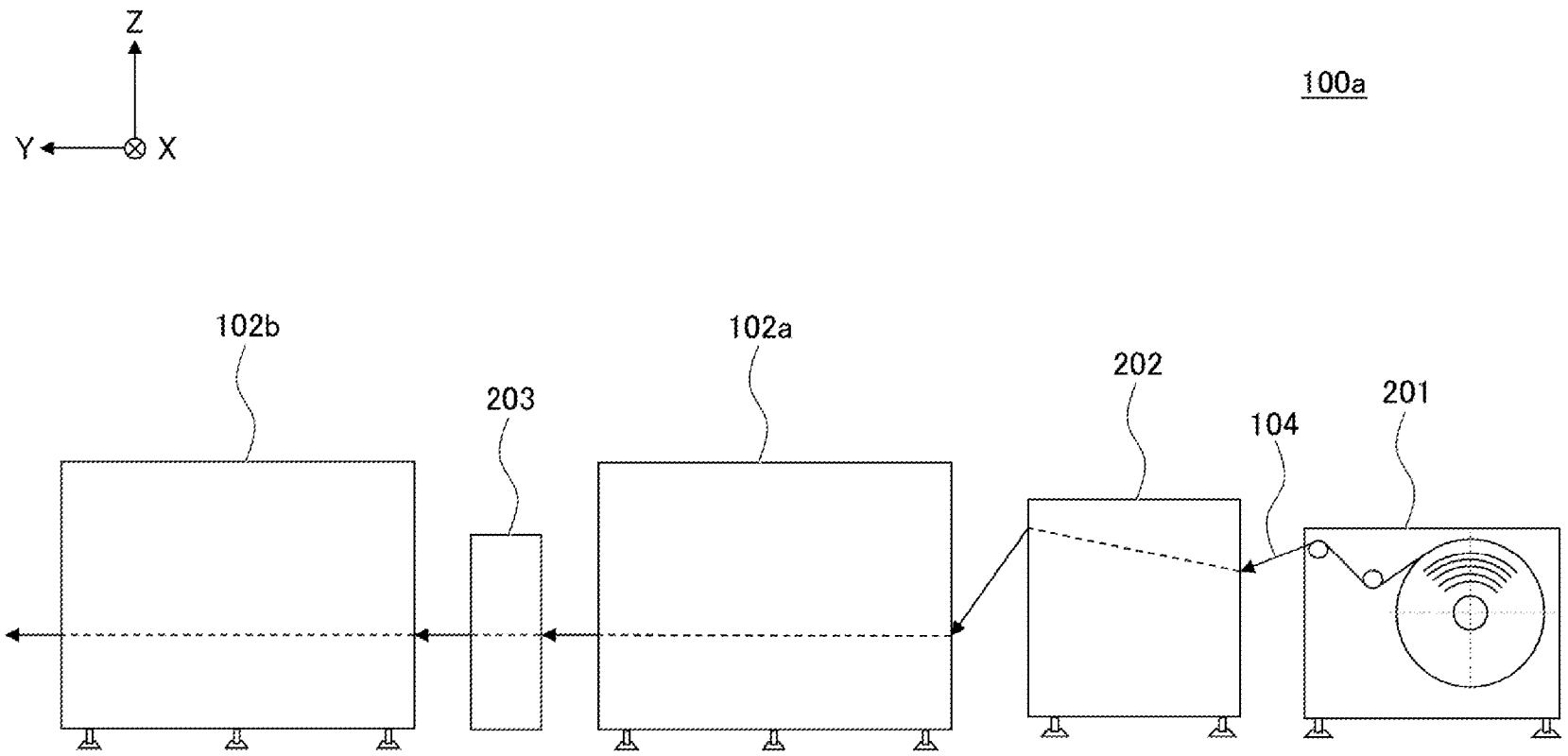
FIG. 9 is a diagram illustrating an overall structure of a modified example.

FIG. 9 is a diagram illustrating an overall structure of a modified example. For example, the liquid discharge system is an image forming device 100*a* having the following overall structure.

For example, the image forming device 100*a* includes a first inkjet device 102*a*, an inversion device 203, a second inkjet device 102*b* and so forth, which are examples of the paper feeding device 201, the treatment agent liquid application device 202, and the liquid discharge device.

The web 104 is an example of the transported object and is continuous form paper. The recording medium is, for example, roll paper.

The paper feeding device 201 transports the web 104 to the treatment agent liquid application device 202.

The treatment agent liquid application device 202 performs pre-treatment for the web 104. For example, the treatment agent liquid application device 202 applies a treatment agent liquid to the front and back surfaces of the web 104.

The first inkjet device 102*a* discharges the liquid, which is ink or the like, onto the web 104 to form images. For example, the first inkjet device 102*a* forms an image, represented by image data, on the front surface of the web 104.

The inversion device 203 inverts the front and back of the web 104.

The second inkjet device 102*b* discharges the liquid, which is ink or the like, onto the web 104 to form images. For example, the second inkjet device 102*b* forms an image, represented by image data, on the back surface of the web 104.

Note that the image forming device 100*a* does not have to be structured as illustrated in the drawing. For example, apart from the types of devices illustrated in the drawing, devices that provide pre-treatment or post-treatment may be included. Furthermore, there may be one liquid discharge device, or there may be three or more liquid discharge devices.

[Example Structure for Detecting the Position of the Recording Medium]

Figure 10:
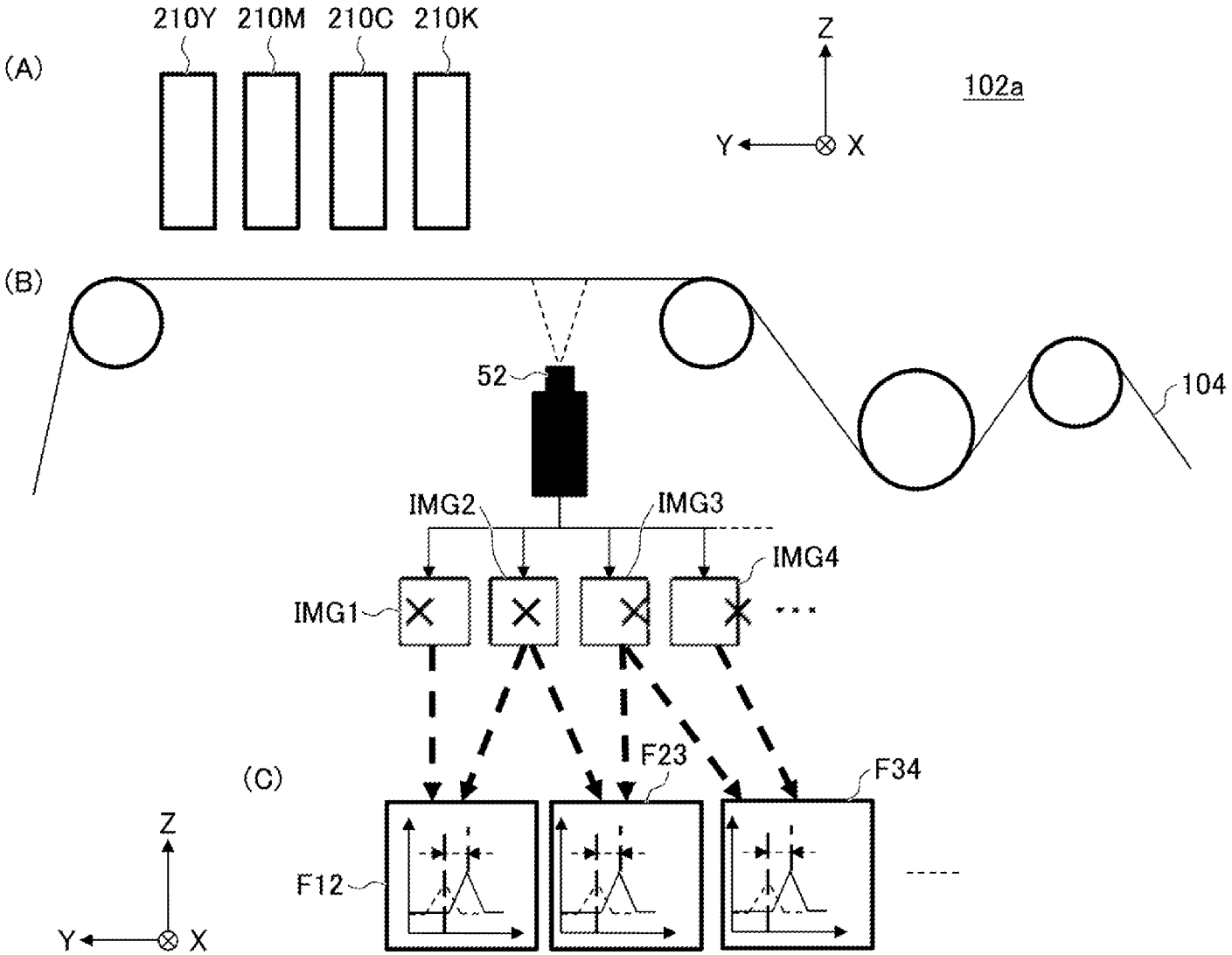
FIG. 10 is a diagram illustrating an example structure for detecting the position of the recording medium by using an image sensor 52.

FIG. 10 is a diagram illustrating an example structure, in which the position of the recording medium is detected by using an image sensor 52. For example, it is desirable for the liquid discharge device to have the following structure.

As illustrated in FIG. 10A, the first inkjet device 102*a* has a hardware structure with an image sensor 52.

The image sensor 52 image-captures the transported web 104 and produces image data. To be more specific, the image sensor 52 image-captures the front surface portion of the web 104 on a predetermined cyclical basis.

FIG. 10B is a diagram schematically showing the cycle in which the image sensor 52 captures images. Hereinafter, the image data will be referred to as the "first image data IMG1," the "second image data IMG2," the "third image data IMG3," the "fourth image data IMG4," and so on, in the order they are captured.

Subsequently, the first inkjet device 102*a* performs a frequency analysis process such as FFT (Fast Fourier Transform) on the image data. By using the result of the frequency analysis process performed this way, the first inkjet device 102*a* calculates the peak of image correlation between the two image data.

FIG. 10C is a diagram illustrating an example of frequency analysis results. To be more specific, the first inkjet device 102*a* generates the "first analysis result F12" based on the first image data IMG1 and the second image data IMG2. Similarly, the first inkjet device 102*a* generates the "second analysis result F23" based on the second image data IMG2 and the third image data IMG3. Following this, the first inkjet device 102*a* generates the "third analysis result F34" based on the third image data IMG3 and the fourth image data IMG4. The peak is calculated in analysis result.

Based on the peaks calculated in this way, the first inkjet device 102*a* calculates the amount of transport. To be more specific, the first inkjet device 102*a* calculates the displacement of the patterns formed on the surface of the web 104 by comparing the positions where the peaks are found. Based on this result, the first inkjet device 102*a* generates a pulse, for example, every time the feed amount reaches a certain level.

Structured this way, similarly to the encoder rollers and the like, the first inkjet device 102*a* can generate signals to represent, for example, the displacement, the speed of transport, or a combination of these. Furthermore, having a structure for detecting the position of the web 104 by using the image sensor 52 makes it possible to spare the task of providing slits or the like in the web 104 in advance.

Other Embodiments

The liquid discharge method described above may be implemented by using, for example, a program or the like. That is, the liquid discharge method may be a method to be executed on a computer by causing an arithmetic and logic device, a memory device, an input device, an output device, and a control device to cooperate based on the program. Furthermore, the program may be written in a memory device, a memory medium, and so forth and distributed, or may be distributed through a telecommunication line or the like.

Each device described above does not have to be a single device. That is, a system in which each device is composed of a number of devices is equally possible.

The image forming device may be, for example, a commercial printing machine or the like (for example, a large-scale electrophotographic printer, an inkjet printer, and so forth).

The recording medium is, for example, paper (also referred to as "plain paper"). However, besides non-plain paper, for example, coated paper and label paper, and, furthermore, an overhead projector sheet, a film, a thin plate having flexibility, and so forth can be used for the recording medium. Furthermore, the recording medium may be roll paper or the like.

That is, the material of the recording medium may be any material, to which paint such as ink droplets or toner can be attached, temporarily attached, or attached and adhered, or into which such material can permeate.

To be more specific, for the recording medium, recording media such as paper, cloth, and film, electronic components such as an electronic substrate and a piezoelectric element (also referred to as a "piezoelectric member" or the like), a granular-material layer (also referred to as a "powder layer" or the like), an organ model, cells for testing, and so forth may be used.

As described above, the material of the recording medium may be, for example, paper, thread, fiber, cloth, leather, metal, plastic, glass, wood, b ceramic, or a combination of these, to which paint can be attached.

Note that the present disclosure is by no means limited to the above-exemplified embodiments, and various modifications can be made without departing from the technical scope of the present disclosure. All technical matters pertaining to the technical concepts recited in the herein-contained claims are in the scope of the present disclosure. Although the above embodiments show suitable examples, those skilled in the art can realize various modified examples from the contents disclosed herein. Such modifications are also within the technical scope recited in the herein-contained claims.

What is claimed is:

1. A liquid discharge device comprising:

a transporter configured to transport a recording medium in a transport direction by using a rotating body;

a first detector configured to detect a first measure of detection indicating an amount of rotation of the rotating body;

a plurality of second detectors, each second detector configured to detect a corresponding second measure of detection of a plurality of second measures of detection, each second measure of detection being based on a pattern on the recording medium identified by image-capturing the recording medium to indicate one or more of a position of the recording medium in the transport direction or a transport speed of the recording medium in the transport direction;

a corrector configured to calculate a second timing by correcting a first timing based on each second measure of detection of the plurality of second measures of detection, the first timing being for discharging a liquid determined based on the first measure of detection; and a plurality of dischargers provided from upstream to downstream in the transport direction, each configured to discharge the liquid to the recording medium at the second timing, wherein each second detector of the plurality of second detectors is provided upstream of a corresponding discharger of the plurality of dischargers, and wherein the corrector is further configured to calculate the second timing for each discharger based on a result of correction based on a corresponding second detector upstream of said each discharger.

2. The liquid discharge device according to claim 1, wherein:

the first detector is an encoder configured to generate a first pulse showing the first measure of detection;

the second timing is calculated by using a counter value, the counter value counting second pulses obtained by dividing a first pulse into equal portions in time; and when a correction amount for the second timing is one period or more of the first pulse, the corrector changes a reference timing that is a timing to serve as a point of reference, and calculates the second timing.

3. The liquid discharge device according to claim 1, wherein:

the second detector calculates a displacement of the pattern, calculates a variation in the transport speed, and calculates an amount of correction so as to negate a desynchronization that is caused by the variation; and the corrector calculates the second timing by using the amount of correction.

4. A liquid discharge method performed by a liquid discharge device, the liquid discharge method comprising:

transporting a recording medium in a transport direction by using a rotating body;

detecting a first measure of detection indicating an amount of rotation of the rotating body;

detecting a plurality of second measures of detection based on a pattern on the recording medium identified by image-capturing the recording medium, each second measure of detection of the plurality of second measures of detection indicating one or more of a position of the recording medium in the transport direction or a transport speed of the recording medium in the transport direction;

calculating a plurality of second timings by correcting a first timing based on each second measure of detection of the plurality of second measures of detection, the first timing being for discharging a liquid determined based on the first measure of detection; and discharging the liquid to the recording medium at each second timing of the plurality of second timings.

5. A non-transitory recording medium having a program recorded therein for causing a computer to execute the liquid discharge method of claim 4.

* * * * *